US007172192B2

(12) United States Patent
Mitsuhashi

(10) Patent No.: US 7,172,192 B2
(45) Date of Patent: Feb. 6, 2007

(54) PAPER FEEDING DEVICE

(75) Inventor: Masaaki Mitsuhashi, Daito (JP)

(73) Assignee: Funai Electric Co., Ltd., Daito (JP)

( * ) Notice: Subject to any disclaimer, the term of this patent is extended or adjusted under 35 U.S.C. 154(b) by 25 days.

(21) Appl. No.: 10/892,199

(22) Filed: Jul. 16, 2004

(65) Prior Publication Data

US 2005/0133981 A1 Jun. 23, 2005

(30) Foreign Application Priority Data

Jul. 16, 2003 (JP) ..... 2003-275527

(51) Int. Cl.
*B65H 3/52* (2006.01)

(52) U.S. Cl. ..... 271/121; 271/167

(58) Field of Classification Search ..... 271/126, 271/121, 16, 19, 21, 167
See application file for complete search history.

(56) References Cited

U.S. PATENT DOCUMENTS

| | | | | |
|---|---|---|---|---|
| 6,536,757 | B2 * | 3/2003 | Chang | 271/16 |
| 6,712,351 | B2 * | 3/2004 | Hsieh | 271/121 |
| 7,011,303 | B2 * | 3/2006 | Takito et al. | 271/121 |
| 2006/0180993 | A1 * | 8/2006 | Lee | 271/121 |

FOREIGN PATENT DOCUMENTS

| | | |
|---|---|---|
| JP | 2001-322732 | 11/2001 |
| JP | 3092259 | 12/2002 |
| JP | 2003-40471 | 2/2003 |
| JP | 2003-128288 | 5/2003 |

OTHER PUBLICATIONS

Japanese Office Action Dated Nov. 18, 2005 with English Translation (Four (4) Pages).

* cited by examiner

*Primary Examiner*—Patrick Mackey
*Assistant Examiner*—Jeremy R Severson
(74) *Attorney, Agent, or Firm*—Crowell & Moring LLP

(57) ABSTRACT

A base part of a paper feeding device for supporting paper edges of a plurality of sheets of paper is provided with paper feeding load applying means which extends in a paper feeding direction and includes a plurality of convex portions having a same height and arranged on a surface of the paper feeding load applying means in parallel in a paper feeding direction, and a paper feeding roller which comes in contact with an uppermost sheet of paper to apply a feeding force to the sheet of paper. A surface of the paper feeding load applying means is divided into a front side region and a back side region, and all the convex portions positioned in the back side region are eliminated thereby to form a flat face in the back side region.

3 Claims, 3 Drawing Sheets

PAPER FEEDING DEVICE

BACKGROUND OF THE INVENTION

1. Field of the Invention

The present invention relates to a paper feeding device which is employed as a paper feeding mechanism in a printing apparatus such as an inkjet printer, and more particularly, to the paper feeding device which is so designed as to stock paper by mounting a plurality of sheets of paper in a stack on a paper mount erected in a slanted shape.

2. Description of the Related Art

FIG. 2 is a schematic perspective view for explaining a structure of a paper feeding device of this type. In the drawing, reference numeral 1 designates a base part, 2 designates a paper mount which is divided into a stationary slanted part 21 formed of synthetic resin integrally with the base part 1, and a movable slanted part 22 foldably connected to this stationary slanted part 21. Moreover, a paper feeding load applying unit 3 which is called as "a buckler friction" is provided at one position in a lateral direction of the base part 1, and a paper feeding roller 4 composed of a pickup roller is provided above this paper feeding load applying unit 3. Paper edges 101 of a plurality of sheets of paper 100 which are mounted in a stack on the paper mount 2 are supported by the base part 1 and the paper feeding load applying unit 3.

By the way, in the paper feeding device of this type, when the paper feeding roller 4 has come into contact with an uppermost sheet of paper (a first sheet) among the plurality of sheets of paper 100 mounted in a stack on the paper mount 2 thereby to rotate, a feeding force by the paper feeding roller 4 will be directly applied to the first sheet. On the other hand, to a second sheet lying under the first sheet and a third sheet lying under the second sheet, feeding forces which are caused by friction with the respective overlying sheets will be given. In view of the above, in the paper feeding device of this type, loads for restraining the second and third sheets of paper from being fed with the feeding forces caused by the friction between the sheets are given to the second, third and succeeding sheets, for the purpose of preventing such multiple feed that the second and third sheets of paper may be also fed, by the friction, following the first sheet. The above described a paper feeding load applying unit 3 serves to provide a function of generating such loads (paper feeding loads).

Meanwhile, as illustratively shown in FIG. 3, the paper mount 2 is erected in a slanted shape with respect to the base part 1. Therefore, when the sheets of paper 100 are mounted in a stack on the paper mount 2 having their paper edges 101 supported by the base part 1 and the paper feeding load applying unit 3, erection angles of the sheets of paper 100 with respect to a surface of the paper feeding load applying unit 3 is generally larger in the lower sheets which are close to the paper mount 2 than in the upper sheets which are remote from the paper mount 2. For example, provided that the erection angle of the first sheet of paper 100 is $\theta 1$, and the erection angle of the lowermost sheet of paper 100 is $\theta 2$, the angle $\theta 1$ is smaller than the angle $\theta 2$, in many cases. When the erection angles of the two sheets overlapped on each other are compared, the erection angle of the upper sheet is equal to or smaller than the erection angle of the lower sheet, in many cases.

On the other hand, FIG. 4 shows the paper feeding load applying unit 3 employed in the conventional paper feeding device. As shown in the drawing, this paper feeding load applying unit 3 has an elongated surface of rubber material on which convex portions 31 in a serrated shape having a same height are formed along its entire length, at an equal interval in a longitudinal direction. The paper feeding load applying unit 3 having such structure is provided in a case 32 which is mounted on the base part 1 described referring to FIG. 2, and the convex portions 31 of the paper feeding load applying unit 3 serve to generate the above described paper feeding load for preventing the multiple feed. More specifically, it is so constructed that although the paper edge 101 of the first sheet of paper 100 to which the feeding force has been directly given by the rotation of the paper feeding roller 4, as shown in FIGS. 2 and 3, can overcome the paper feeding load given by the convex portions 31 of the paper feeding load applying unit 3 to go across the convex portions 31, the paper edges 101 of the second and third sheets which have received the feeding force by the friction between the sheets will be influenced by the paper feeding load given by the convex portions 31 of the paper feeding load applying unit 3, and will be unable to easily go across the convex portions 31.

There has been known another conventional example, in which a part of an upper face of the case 32 described referring to FIG. 4 is made higher, so that the heights of the convex portions 31 of the paper feeding load applying unit 3 with respect to the upper face of the case 32 may be relatively smaller in an area close to the paper mount than in an area remote from the paper mount (See Japanese Utility Model Registration No. 3092259, for example). There has been known still another conventional example, in which for the purpose of preventing the multiple feed of the sheets of paper which have been mounted on a paper feeding cassette of lateral mounting type in an image forming apparatus, a slope separating plate is provided at a paper discharging side of the paper feeding cassette, and means for applying a load to the discharged sheet thereby to prevent the multiple feed is provided at an upper end part of the slope separating plate (See JP-A-2003–128288, for example).

It has been found that, in the conventional paper feeding device provided with the paper feeding load applying unit 3 as described referring to FIG. 4, magnitudes of the feeding loads given to the sheets of paper by the convex portions 31 of the paper feeding load applying unit 3 depend on the erection angles of the sheets of paper 100 with respect to the surface of the paper feeding load applying unit 3, and that a larger paper feeding load will be generated in case where the erection angle is larger than in case where the erection angle is smaller. For this reason, in the conventional paper feeding device provided with the paper feeding load applying unit 3 as described referring to FIG. 4, even though the upper sheets of paper 100 having the smaller erection angles are normally fed one by one by the rotation of the paper feeding roller 4 without causing the multiple feed, normal paper feeding motion will not be performed, in some cases, with the lower sheets of paper 100 having the larger erection angles, because the paper feeding load given by the paper feeding load applying unit 3 has become too large. According to cases, the paper edge 101 of the sheet of paper 100 to which the feeding force by the paper feeding roller 4 has been given may be butted against the surface of the paper feeding load applying unit 3 to be folded in a crushed state, and so-called paper jam may happen.

In this respect, according to the paper feeding load applying unit which is disclosed in Japanese Utility Model Registration No. 3092259, the paper feeding motions are conducted without occurrence of the paper jam in all the sheets of paper stacked on the paper mount, because the paper feeding load to the upper sheets having the smaller erection angles becomes larger, while the paper feeding load to the lower sheets having the larger erection angles is depressed to be smaller. However, in this case, the upper face of the case to which the paper feeding load applying unit is mounted must be modified in shape to attain the purpose, and there has been a problem that a structure of a mold for molding the case has become complicated, and a rise of production cost has been inevitable.

On the other hand, the paper feeding load applying unit which is disclosed in JP-A-2003-128288 has merely such a structure that the area for generating the load is formed at the upper end part of the slope separating plate, for the purpose of preventing the multiple feed of the sheets of paper mounted on the paper feeding cassette of the lateral mounting type. Therefore, it is not sufficiently effective as means for preventing the multiple feed, under circumstances where every sheet of paper has a different erection angle, as described referring to FIG. 3.

SUMMARY OF THE INVENTION

The present invention has been made under the above described circumstances, and it is an object of the invention to provide a paper feeding device which can perform effective function for preventing multiple feed, by adding a simple modification to a structure of the paper feeding load applying unit which has been described referring to FIG. 4, under the circumstances where every sheet of paper has a different erection angle.

A paper feeding device according to the invention includes a base part for supporting paper edges of a plurality of sheets of paper which have been mounted in a stack on a paper mount erected in a slanted shape, the base part being provided with a paper feeding load applying unit which extends in a paper feeding direction and includes a plurality of convex portions having a same height and arranged on a surface of the paper feeding load applying unit in parallel in a paper feeding direction, and a paper feeding roller which comes in contact with an uppermost sheet of paper among the sheets of paper whose paper edges are mounted on the paper feeding load applying unit thereby to apply a feeding force to the sheet of paper. Then, an area of the surface of the paper feeding load applying unit on which the paper edges of the plurality of sheets of paper are mounted is divided into a front side region and a back side region with respect to the paper feeding direction, and all the convex portions positioned in the back side region are eliminated, whereby paper feeding load generated in the back side region is made smaller than the paper feeding load generated in the front side region.

As measures to be taken for making the paper feeding load generated in the back side region smaller than the paper feeding load generated in the front side region, it is advantageous to form the surface of the paper feeding load applying unit to have a flat face in the back side region. It is also desirable that the surface of the paper feeding load applying unit has a rubber face.

By employing the above described structure, the paper edges of the upper sheets of paper having the smaller erection angles, among the plurality of the sheets of paper which have been mounted in a stack on the paper mount erected in a slanted shape, will be placed in the front side region of the surface of the paper feeding load applying unit provided with the convex portions. On the other hand, the paper edges of the lower sheets of paper having the larger erection angles will be placed in the back side region of the surface of the paper feeding load applying unit where the convex portions have been eliminated and the paper feeding load has been depressed smaller. For this reason, magnitude of the paper feeding load combining the paper feeding load depending on the erection angles of the sheets of paper and the paper feeding load depending on the presence or absence of the convex portions on the surface of the paper feeding load applying unit will be uniformalized with respect to all the sheets of paper which have been stacked on the paper mount. As the results, the sheets of paper which have been mounted in a stack on the paper mount will be fed one by one without causing multiple feed, irrespective of the number of the sheets, and paper jam will not happen.

Particularly, in case where the surface of the paper feeding load applying unit has been formed to have a flat face in the back side region, the shape of the case need not be modified as proposed in Japanese Utility Model Registration No. 3092259, and this would be advantageous in respect of the production cost. On the other hand, in case where the structure that the surface of the paper feeding load applying unit has a rubber face is employed, the paper feeding load will be efficiently given to the sheets of paper by the rubber face, and so, occurrence of the multiple feed or jam of the sheets of paper can be more effectively prevented.

The paper feeding device according to the invention will be further embodied by employing the following structure. The paper feeding device includes a base part for supporting paper edges of a plurality of sheets of paper which have been mounted in a stack on a paper mount erected in a slanted shape, the base part being provided with a paper feeding load applying unit which extends in a paper feeding direction and includes a plurality of convex portions having a same height and arranged on a surface of the paper feeding load applying unit in parallel in a paper feeding direction, and a paper feeding roller which comes in contact with an uppermost sheet of paper among the sheets of paper whose paper edges have been mounted on the paper feeding load applying unit thereby to apply a feeding force to the sheet of paper, wherein the surface of the paper feeding load applying unit has a rubber face, an area of the surface on which the paper edges of the plurality of sheets of paper are mounted is divided into a front side region and a back side region with respect to the paper feeding direction, and all the convex portions positioned in the back side region are eliminated thereby to form a flat face in the back side region, whereby paper feeding load generated in the back side region is made smaller than the paper feeding load generated in the front side region, and that the paper feeding roller is provided above the paper feeding load applying unit. Performance of this invention will be explained referring to an embodiment which will be described below.

As described above, according to the paper feeding device of this invention, by adding a simple modification to the structure of the paper feeding load applying unit, the magnitude of the paper feeding load will be uniformalized with respect to all the sheets of paper which have been stacked on the paper mount. As the results, the sheets of paper will be fed one by one without causing multiple feed, irrespective of the number of the sheets, and paper jam will not happen. Therefore, it will be possible to provide the paper feeding device having excellent paper feeding performance at a low cost, and further, in case where the paper feeding device has been employed in a printing apparatus or the like, such phenomenon that printing quality may be deteriorated due to occurrence of multiple feed or jam of paper will hardly happen.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
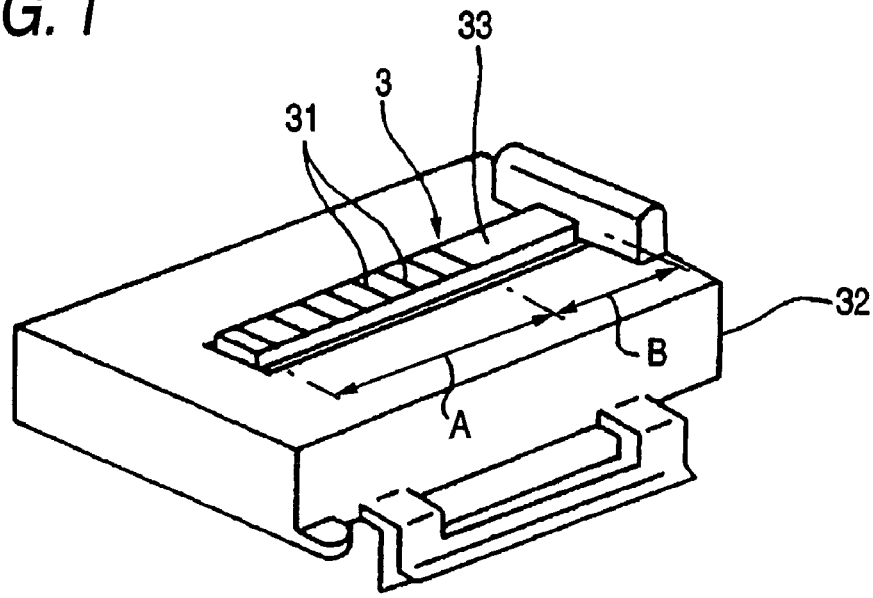
FIG. 1 is a schematic perspective view showing a paper feeding load applying unit and a case thereof employed in a paper feeding device according to the invention.

FIG. 1 is a schematic perspective view showing paper feeding load applying unit 3 employed in a paper feeding device according to the invention, and a case 32 thereof. The feeding load applying unit 3 in the drawing is formed of synthetic resin or rubber into an elongated shape having a surface of rubber material. An area of the surface on which paper edges of a plurality of sheets of paper (not shown) are mounted is divided into a front side region A and a rear side region B in a paper feeding direction. The front side region A in its entirety is provided with convex portions 31 in a serrated shape having a same height which are formed at an equal interval in a longitudinal direction, and the rear side region B is formed as a flat face 33 in its entirety. This feeding load applying unit 3 corresponds to the conventional feeding load applying unit 3 which has been described referring to FIG. 4, in which all the convex portions positioned in a part of the surface corresponding to the rear side region are eliminated, and the rear side region B is made to have a flat face.

Figure 2:
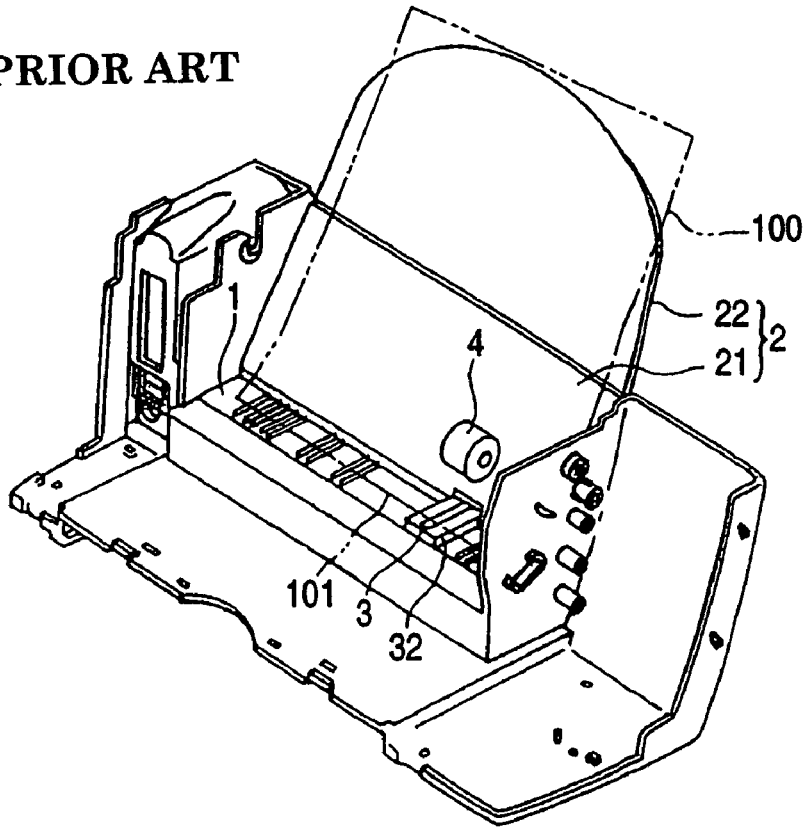
FIG. 2 PRIOR ART
FIG. 2 is a schematic perspective view for explaining a structure of the paper feeding device.

As has been described referring to FIG. 2, this paper feeding load applying unit 3 is provided in the case 32 which is mounted on the base 1, and the paper feeding roller 4 is arranged above the paper feeding load applying unit 3.

According to the above described structure of the paper feeding load applying unit 3, in case where the erection angles of the sheets of paper are equal, the paper feeding load generated in the back side region of the surface of the paper feeding load applying unit 3 will be smaller than the paper feeding load generated in the front side region.

Figure 3:
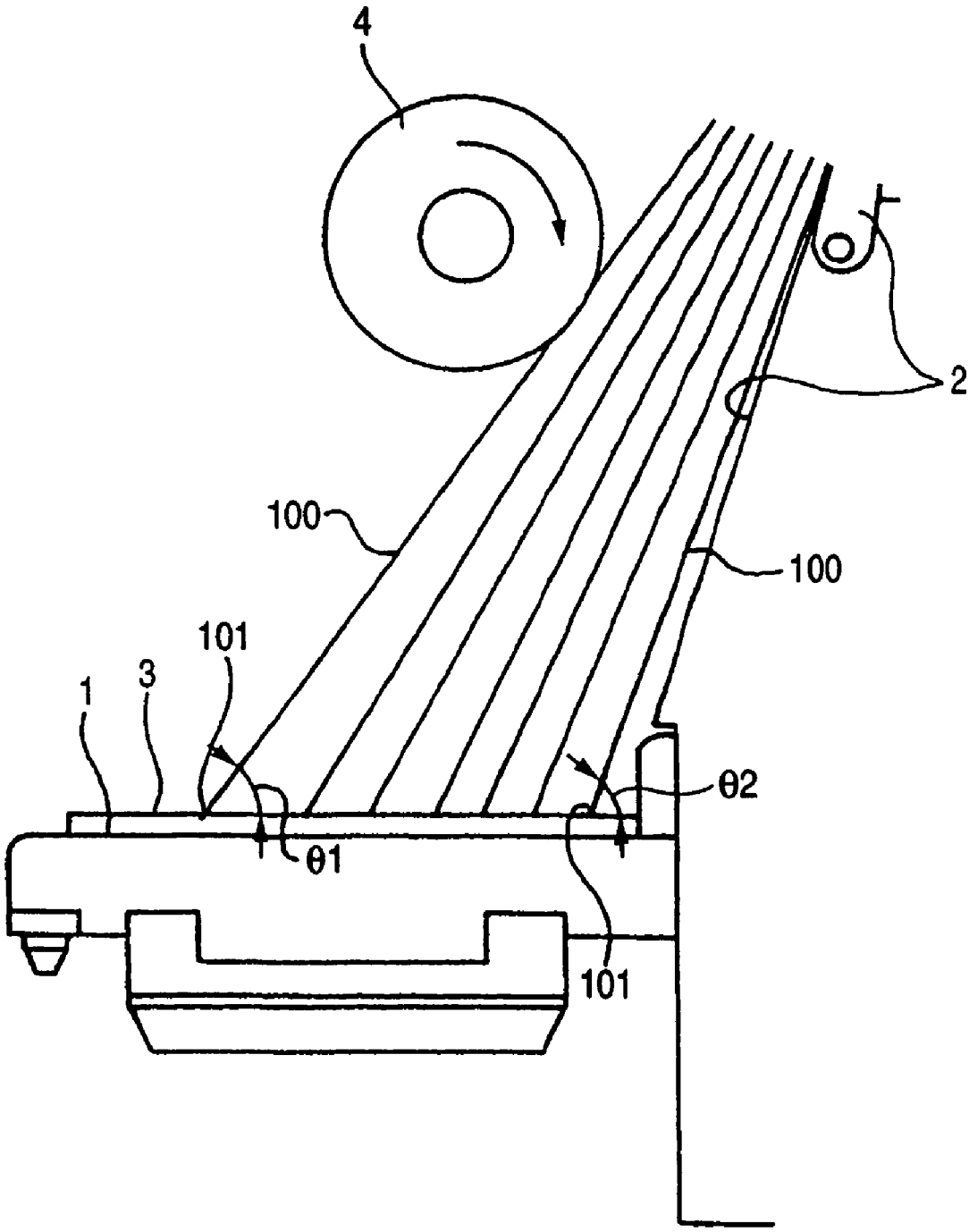
FIG. 3 PRIOR ART
FIG. 3 is an explanatory view for explaining relation between erection angles of sheets of paper and paper feeding loads.

In the paper feeding device having the above described structure, as known from FIGS. 2 and 3, the paper edges 101 of the upper sheets of paper 100 having the smaller erection angle, among the plurality of the sheets of paper 100 which have been mounted in a stack on the paper mount 2 erected in a slanted shape, will be placed in the front side region A of the surface of the paper feeding load applying unit 3 provided with the convex portions 31. On the other hand, the paper edges 101 of the lower sheets of paper 100 having the larger erection angles will be placed in the back side region B of the surface of the paper feeding load applying unit 3 where the convex portions have been eliminated and the flat face 33 has been formed. For this reason, the magnitude of the paper feeding load combining the paper feeding load depending on the erection angles of the sheets of paper 100 and the paper feeding load depending on the presence or absence of the convex portions 31 on the surface of the paper feeding load applying unit 3 will be uniformalized with respect to all the sheets of paper 100 which have been stacked on the paper mount 2. As the results, the sheets of paper which have been mounted in a stack on the paper mount 2 will be fed one by one without causing multiple feed, irrespective of the number of the sheets, and paper jam will not happen.

Figure 4:
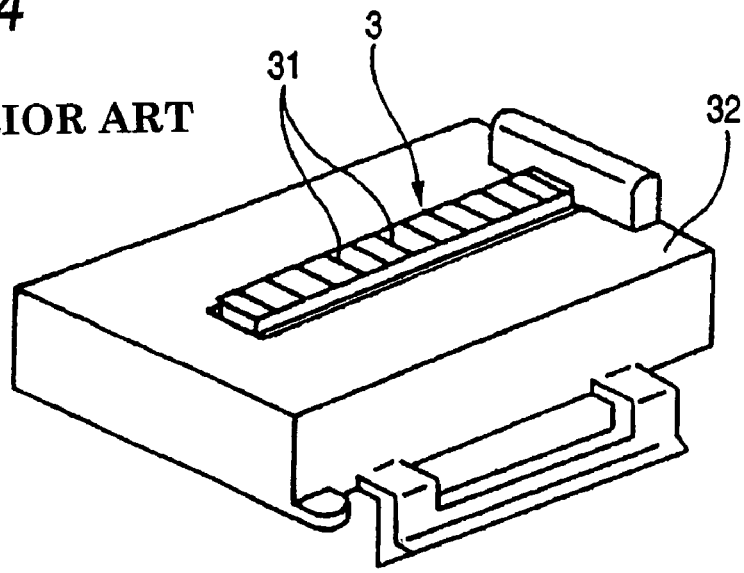
FIG. 4 PRIOR ART
FIG. 4 is a schematic perspective view showing a paper feeding load applying unit and a case thereof employed in a conventional paper feeding device.
Figure 5A:
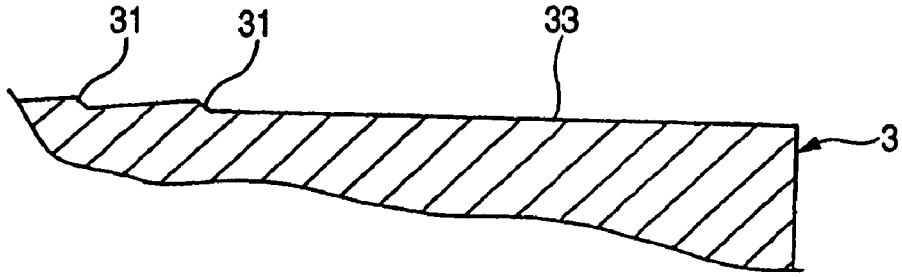
FIG. 5A is an enlarged sectional view showing a shape of a surface of the paper feeding load applying unit in FIG. 1.
Figure 5B:
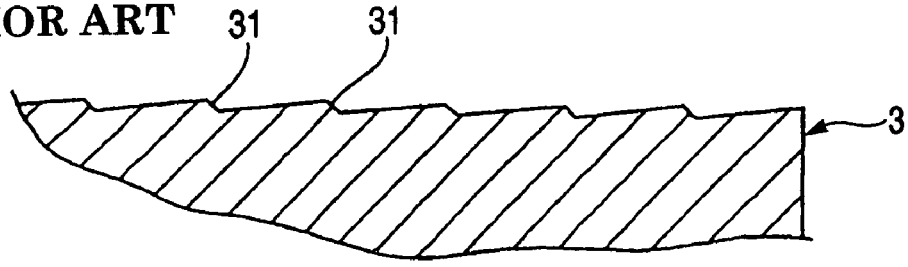
FIG. 5B PRIOR ART
FIG. 5B is an enlarged sectional view showing a shape of a surface of the paper feeding load applying unit in FIG. 4.

FIGS. 5A and 5B are explanatory views in which shapes of the surfaces of the paper feeding load applying unit 3 described referring to FIG. 1 and the paper feeding load applying unit 3 described referring to FIG. 4 are enlarged and compared. FIG. 5A shows the surface of the paper feeding load applying unit 3 described referring to FIG. 1, and FIG. 5B shows the surface of the paper feeding load applying unit 3 described referring to FIG. 4. As apparent from these drawings, in the paper feeding load applying unit 3 in FIG. 5A, about five convex portions 31 positioned in a part of the surface corresponding to the back side region B in FIG. 5B have been eliminated, and the part has been made to have a flat face 33. In this case, it would be sufficient that the back side region B has such a length that three to five sheets lying in the lower stack, among the plurality of the sheets of paper stacked on the paper mount 2, can be held thereon. In this manner, all of the plurality of the sheets of paper stacked on the paper mount 2 will be fed one by one, successively from the upper sheets, without causing multiple feed and paper jam. Particularly, it has been confirmed that such favorable feeding performance can be more easily achieved, in case where the paper feeding roller 4 is arranged above the paper feeding load applying unit 3.

The paper feeding device according to the invention can be utilized as a paper feeding mechanism in a printing apparatus such as an inkjet printer.

What is claimed is:

1. A paper feeding device comprising a base part for supporting paper edges of a plurality of sheets of paper which have been mounted in a stack on a paper mount erected in a slanted shape;

a paper feeding load applying unit which extends in a paper feeding direction and includes a plurality of convex portions having a same height and arranged on a surface of the paper feeding load applying unit in parallel in a paper feeding direction; and a paper feeding roller which comes in contact with an uppermost sheet of paper among the sheets of paper whose paper edges are mounted on the paper feeding load applying unit thereby to apply a feeding force to the sheet of paper, wherein:

the surface of the paper feeding load applying unit has a rubber face;

an area of the surface on which the paper edges of the plurality of sheets of paper are mounted is divided into a front side region and an adjoining back side region with respect to the paper feeding direction;

wherein the plurality of convex portions are arranged only on the front side region, and the back side region has a non-sloping flat face, a longitudinal length in the paper feeding direction of the non-sloping flat face of the back side region is greater than a longitudinal length of at least one convex portion on the front side region, whereby paper feeding load generated in the back side region is made smaller than the paper feeding load generated in the front side region; and the paper feeding roller is provided above the paper feeding load applying unit.

2. A paper feeding device comprising a base part for supporting paper edges of a plurality of sheets of paper which have been mounted in a stack on a paper mount erected in a slanted shape;

a paper feeding load applying unit which extends in a paper feeding direction and includes a plurality of convex portions having a same height and arranged on a surface of the paper feeding load applying unit in parallel in a paper feeding direction, wherein the surface of the paper feeding load applying unit is formed to have a flat face in a back side region; and a paper feeding roller which comes in contact with an uppermost sheet of paper among the sheets of paper whose paper edges are mounted on the paper feeding load applying unit thereby to apply a feeding force to the sheet of paper, wherein:

an area of the surface of the paper feeding load applying unit on which the paper edges of the plurality of sheets of paper are mounted is divided into a front side region and the back side region with respect to the paper feeding direction; and wherein the plurality of convex portions are arranged only on the front side region, and the back side region has a non-sloping flat face, a longitudinal length in the paper feeding direction of the non-sloping flat face being greater than a longitudinal length of at least one convex portion on the front side region, whereby paper feeding load generated in the back side region is made smaller than the paper feeding load generated in the front side region.

3. A paper feeding device according to claim 2, wherein the surface of the paper feeding load applying unit has a rubber face.

* * * * *